US010125518B2

(12) United States Patent
Shiu et al.

(10) Patent No.: US 10,125,518 B2
(45) Date of Patent: Nov. 13, 2018

(54) HANDLE MECHANISM

(71) Applicant: TAIWAN FU HSING INDUSTRIAL CO., LTD., Kaohsiung (TW)

(72) Inventors: Jiun-Nan Shiu, Kaohsiung (TW); Shih-Min Lu, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 755 days.

(21) Appl. No.: 14/606,073

(22) Filed: Jan. 27, 2015

(65) Prior Publication Data

US 2016/0053509 A1 Feb. 25, 2016

(30) Foreign Application Priority Data

Aug. 21, 2014 (TW) ..... 103128772 A

(51) Int. Cl.

*E05B 7/00* (2006.01)
*E05B 47/06* (2006.01)
*E05B 47/00* (2006.01)

(52) U.S. Cl.

CPC ..... *E05B 7/00* (2013.01); *E05B 47/0649* (2013.01); *E05B 47/0012* (2013.01); *E05B 2047/0023* (2013.01)

(58) Field of Classification Search

CPC ..... E05B 47/0012; E05B 2047/0031; E05B 47/0692; Y10T 70/5823; Y10T 70/7062

USPC ..... 292/336.3

See application file for complete search history.

(56) References Cited

U.S. PATENT DOCUMENTS

2001/0005998 A1* 7/2001 Imedio Ocana ..... E05B 47/068 70/277
2005/0086984 A1* 4/2005 Errani ..... E05B 47/0692 70/283
2011/0067464 A1* 3/2011 Chiou ..... E05B 47/0012 70/278.7
2011/0079057 A1* 4/2011 Frolov ..... E05B 47/0673 70/91

FOREIGN PATENT DOCUMENTS

CN 202000752 U 10/2011
CN 202359881 U 8/2012

(Continued)

OTHER PUBLICATIONS

Taiwanese Office Action dated Jan. 11, 2016 for Taiwanese Patent Application No. 103128772, 7 pages.

(Continued)

*Primary Examiner* — Mark A Williams
(74) *Attorney, Agent, or Firm* — Jackson IPG PLLC; Demian K. Jackson

(57) ABSTRACT

A handle mechanism used for driving a lock module in operation includes a handle, a linking member and a transmission rod, wherein the linking member is selectively engaged with the handle and the transmission rod. The handle is unable to drive the lock module in operation by the transmission rod driving and prevents the lock module from damage once an excessive force is applied to the handle when the linking member is not engaged with the handle and the transmission rod. Oppositely, the handle is able to drive the lock module in operation by the transmission rod driving when the linking member is engaged with the handle and the transmission rod.

9 Claims, 10 Drawing Sheets

(56) References Cited

FOREIGN PATENT DOCUMENTS

| | | | |
|---|---|---|---|
| CN | 202658963 | U | 1/2013 |
| CN | 203247944 | U | 10/2013 |
| CN | 203394173 | U | 1/2014 |
| DE | 102008063061 | A1 | 6/2010 |
| TW | M258148 | | 3/2005 |
| TW | M287854 | | 2/2006 |
| TW | 200639312 | | 11/2006 |
| TW | M303244 | | 12/2006 |
| TW | M312579 | | 5/2007 |
| TW | M475495 | | 4/2014 |

OTHER PUBLICATIONS

Chinese Office Action dated Jun. 2, 2017 for Chinese Patent Application No. 201410528575.0, 7 pages.
Chinese Office Action dated Feb. 9, 2018 for Chinese Patent Application No. 201410528575.0, 7 pages.

* cited by examiner

HANDLE MECHANISM

FIELD OF THE INVENTION

The present invention relates to a handle mechanism. The invention particularly relates to the handle mechanism with a linking member which is selectively engaged with a handle and a transmission rod.

BACKGROUND OF THE INVENTION

With reference to FIG. 10, a conventional handle apparatus 10 and a lock module 20 are mounted at a door 30, wherein the handle apparatus 10 is used for driving the lock module 20 in operation to open the door 30. The handle apparatus 10 includes a handle 11 and a transmission rod 12, wherein the handle 11 comprises a rectangular accommodating hole 11*a* and the transmission rod 12 is a rectangular pillar. The transmission rod 12 is inserted and lodged into the rectangular accommodating hole 11*a* of the handle 11, wherein the rectangular accommodating hole 11*a* and the transmission rod 12 interferes and interacts mutually. The handle 11 is able to drive the transmission rod 12 in rotation, and the rotating transmission rod 12 drives a latch 20*a* of the lock module 20 in operation to open the door 30 when the latch 20*a* of the lock module 20 is unlocked. Oppositely, the handle 11 is unable to drive the latch 20*a* of the lock module 20 in operation therefore leading that the door 30 is unable to be opened when the latch 20*a* of the lock module 20 is locked. Owing to the reason that the transmission rod 12 is inserted and lodged into the rectangular accommodating hole 11*a* of the handle 11 and the rectangular accommodating hole 11*a* and the transmission rod 12 interferes and interacts mutually, the handle 11 still drives the transmission rod 12 in rotation, and the rotating transmission rod 12 would compress and deform the linkage apparatus of the lock module 20 to lead the lock module 20 can not be operated normally when an excessive force is applied to the handle 11.

SUMMARY

The primary object of the present invention is to provide a handle mechanism including a case, a handle, a transmission rod and a linking member. The handle comprises a holding portion and a shafting portion wherein the shafting portion is pivotally connected to the case. The transmission rod is used for driving a lock module in operation, and the linking member is selectively engaged with the shafting portion of the handle and the transmission rod. The handle is able to drive the transmission rod in rotation by the linking member that is engaged with the shafting portion and the transmission rod and makes the transmission rod driving the lock module in operation when the handle is made available to drive the lock module in operation. The handle is unable to drive the transmission rod in rotation by the linking member that is departed from the transmission rod and makes the transmission rod unable to drive the lock module in operation when the handle is made unavailable to drive the lock module in operation.

The present invention is making the linking member selectively engaged with the handle and the transmission rod to make the handle unable to drive the transmission rod in rotation and prevent the transmission rod from damaging the lock module when an excessive force is applied to the handle.

DETAILED DESCRIPTION OF THE INVENTION

Figure 1:
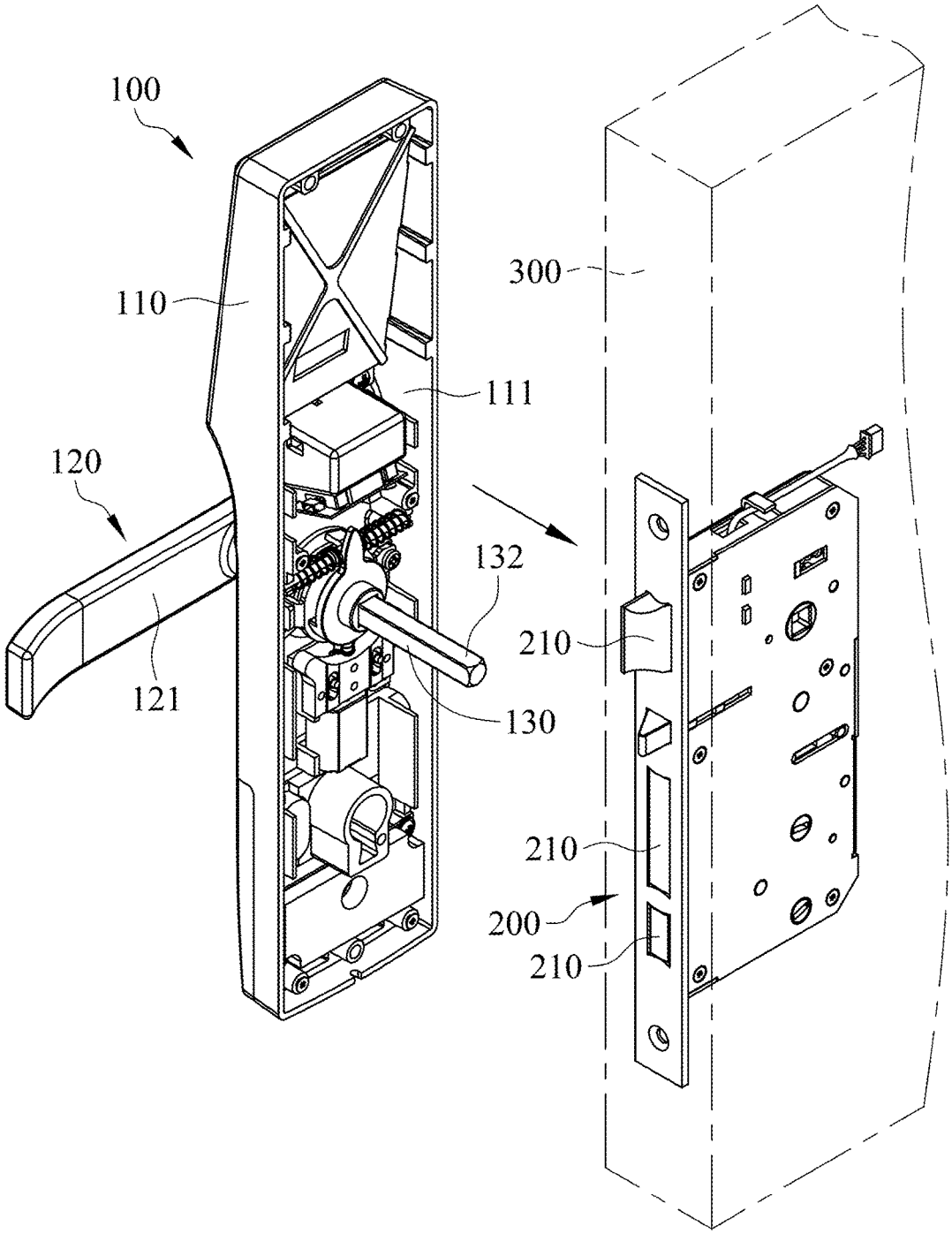
FIG. 1 is a perspective diagram illustrating a handle mechanism in accordance with the present invention.

With reference to FIG. 1, a handle mechanism 100 in accordance with an embodiment of the present invention is disclosed, wherein the handle mechanism 100 and a lock module 200 are mounted at a door 300. The handle mechanism 100 is used for driving a latch 210 of the lock module 200 in operation to control whether the door 300 is opened or not.

Figure 2:
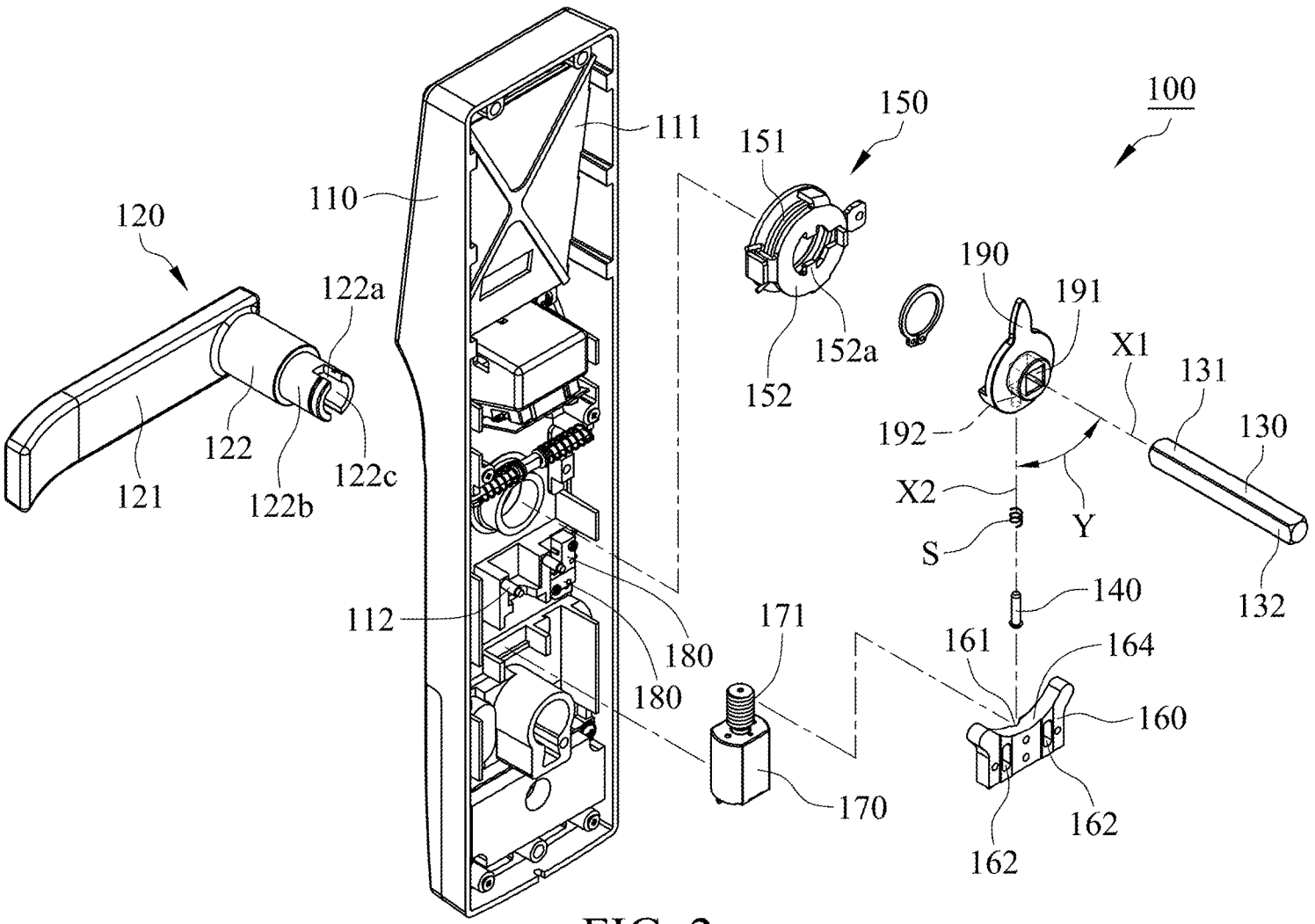
FIG. 2 is a perspective exploded diagram illustrating the handle mechanism in accordance with the present invention.

With reference to FIGS. 1 and 2, the handle mechanism 100 includes a case 110, a handle 120, a transmission rod 130 and a linking member 140, wherein the case 110 comprises an accommodating space 111, and the handle 120 comprises a holding portion 121 and a shafting portion 122. The shafting portion 122 is pivotally connected to the case 110 and penetrates into the accommodating space 111. The linking member 140 enables to selectively engage with the shafting portion 122 of the handle 120 and the transmission rod 130. The handle 120 is able to drive the transmission rod 130 in rotation by the linking member 140 that is engaged with the shafting portion 122 and the transmission rod 130 and makes the transmission rod 130 driving the lock module 200 in operation when the handle 120 is made available to drive the lock module 200 in operation. The handle 120 is unable to drive the transmission rod 130 in rotation by the linking member 140 that is departed from the transmission rod 130 and makes the transmission rod 130 unable to drive the lock module 200 in operation when the handle 200 is made unavailable to drive the lock module 200 in operation.

With reference to FIGS. 1 and 2, the handle mechanism 100 further includes a restoration module 150 having a torsion spring 151 and a driving plate 152, wherein the restoration module 150 is engaged with the shafting portion 122 of the handle 120 by the driving plate 152. The shafting portion 122 rotates following the holding portion 121 and drives the driving plate 152 to make the torsion spring 151 generating a restoring elastic force when the holding portion 121 performs swinging by application of an external force. Oppositely, the torsion spring 151 pushes the driving plate 152 restore to original position by the restoring elastic force, and the driving plate 152 drives the shafting portion 122 in rotation to make the holding portion 121 of the handle 120 restoring to original position when an external force applied to the holding portion 121 is vanished. In this embodiment, the shafting portion 122 comprises at least one constraining slot 122*a*, the driving plate 152 comprises at least one tenon portion 152*a*, and the driving plate 152 is lodged into the constraining slot 122*a* of the shafting portion 122 by the tenon portion 152*a* to make the handle 120 and the driving plate 152 in operation simultaneously.

With reference to FIGS. 1 and 2, the transmission rod 130 of the handle mechanism 100 is used for driving the latch 210 of the lock module 200 in operation to unlock the lock module 200. In this embodiment, the transmission rod 130 comprises a first end 131 and a second end 132, wherein the first end 131 is used for engaging with the shafting portion 122 of the handle 120, and the second end 132 is used for engaging with the lock module 200 to drive the lock module 200 in operation.

With reference to FIG. 2, in this embodiment, the shafting portion 122 of the handle 120 comprises an axial wall 122*b* and an accommodating hole 122*c* wherein the axial wall 122*b* surrounds the accommodating hole 122*c*. The constraining slot 122*a* disposed at the axial wall 122*b* penetrates through the axial wall 122*b* and communicates with the accommodating hole 122*c*. The linking member 140 corresponds to the constraining slot 122*a* of the shafting portion 122.

With reference to FIGS. 1, 2, 3 and 4, the first end 131 of the transmission rod 130 is inserted into the accommodating hole 122*c*, the constraining slot 122*a* reveals the first end 131 of the transmission rod 130, the accommodating hole 122*c* and the first end 131 of the transmission rod 130 do not interfere mutually. In this embodiment, the accommodating hole 122*c* is a round-shaped hole, and the transmission rod 130 is a non round-shaped pillar.

Figure 3:
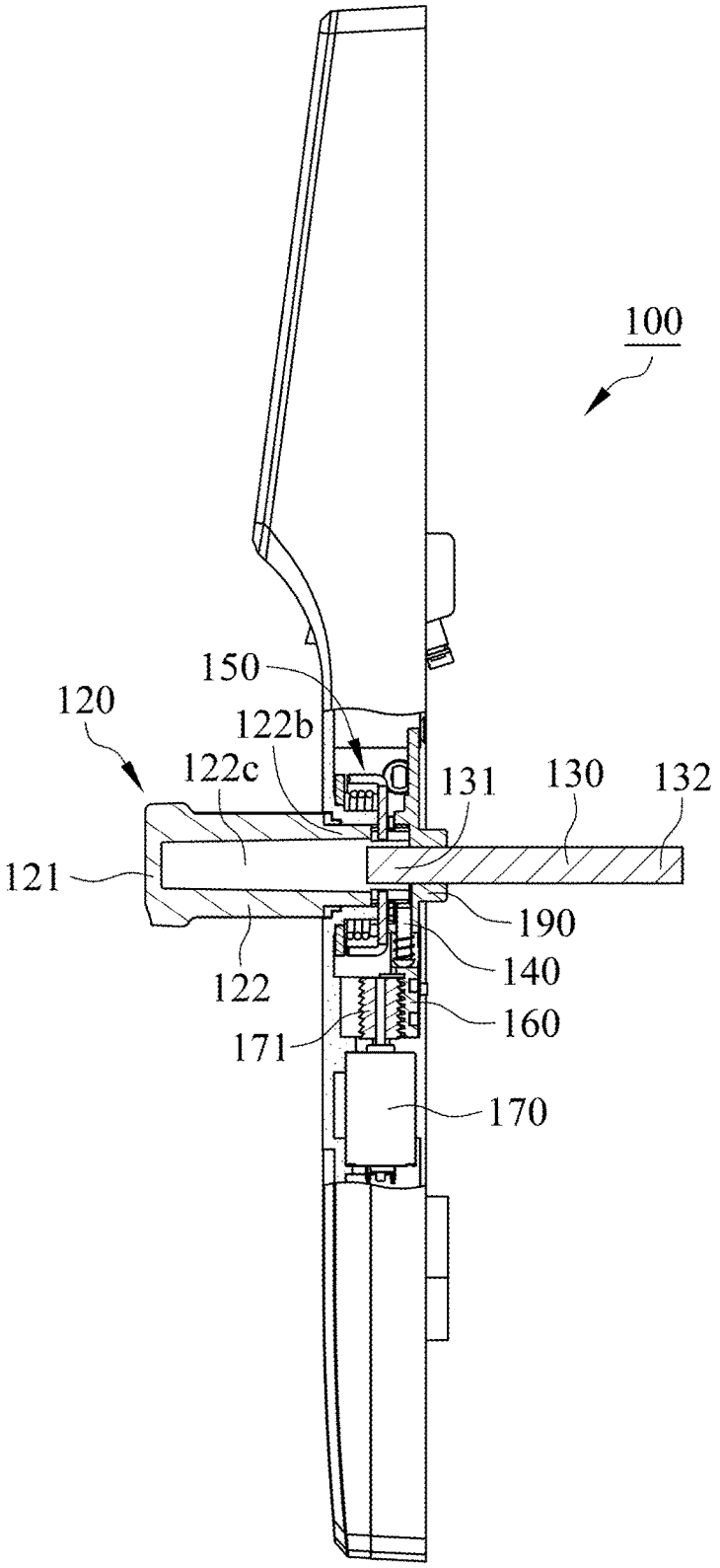
FIG. 3 is a sectional diagram illustrating the handle mechanism in accordance with the present invention.
Figure 4:
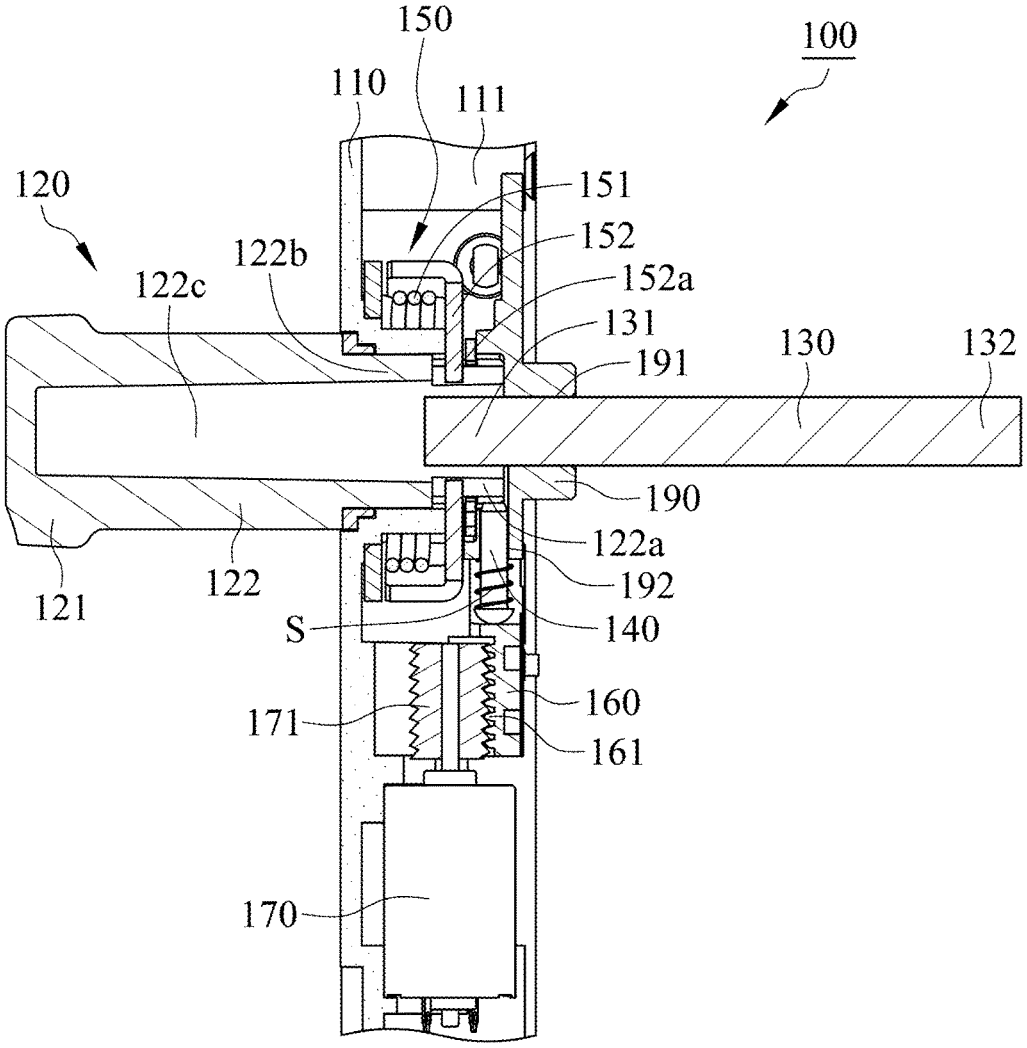
FIG. 4 is a partial enlargement view of FIG. 3.
Figure 5:
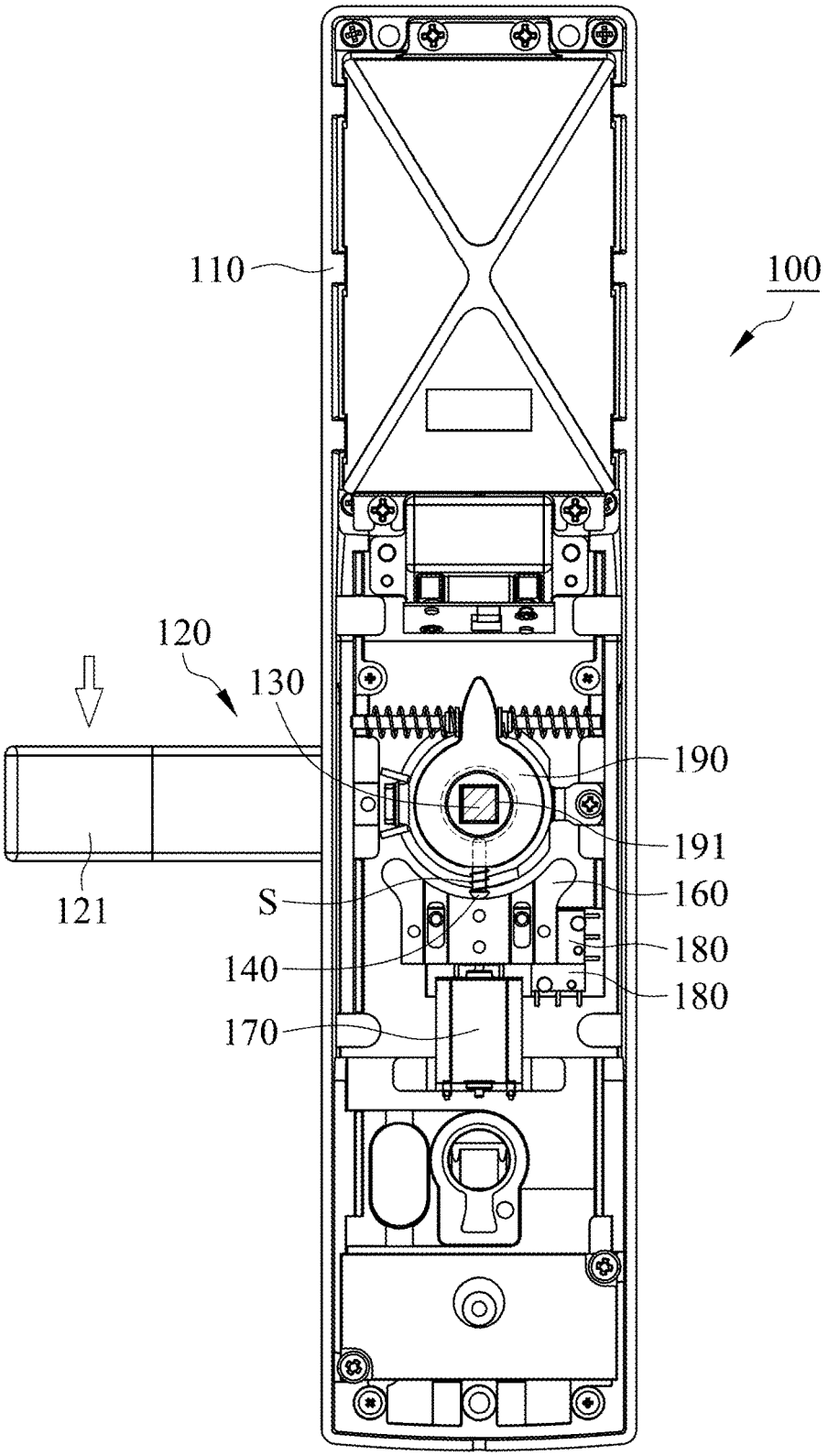
FIG. 5 is a rear view illustrating the handle mechanism in accordance with the present invention.

With reference to FIGS. 3 and 4, the linking member 140 movably penetrates into the shafting portion 122 of the handle 120. In this embodiment, the linking member 140 is able to penetrate into the constraining slot 122*a* of the shafting portion 122 and moves toward the transmission rod 130 to contact against the transmission rod 130 or the linking member 140 is able to depart from the transmission rod 130 reversely.

With reference to FIGS. 2, 3 and 4, the handle mechanism 100 further includes a pushing member 160 and a motor 170, wherein the motor 170 is used for driving the pushing member 160 to move. In this embodiment, the pushing member 160 comprises a supporting portion 161, the motor 170 comprises a rotation shaft 171, the supporting portion 161 is engaged with the rotation shaft 171, and the pushing member 160 contacts against the linking member 140.

With reference to FIGS. 3 and 4, the rotation shaft 171 of the motor 170 drives the pushing member 160 to move when the rotation shaft 171 of the motor 170 rotates toward a first direction, the pushing member 160 pushes the linking member 140 to make the linking member 140 protruding to the constraining slot 122*a* of the shafting portion 122 and contacting against the transmission rod 130. Oppositely, the pushing member 160 does not push the linking member 140 when the rotation shaft 171 rotates toward a second direction, and the linking member 140 enables to depart from the transmission rod 130.

With reference to FIGS. 2, 3 and 4, the case 110 comprises at least one constraining member 112, the pushing member 160 comprises at least one constraining rail 162, and the constraining member 112 is engaged with the constraining rail 162. In this embodiment, the constraining rail 162 is a long slot, and the constraining member 112 penetrates into the long slot. The constraining rail 162 and the constraining member 112 are used for constraining the moving distance of the pushing member 160 and preventing the pushing member 160 from deviation.

With reference to FIGS. 2, 3, 4, 5 and 6, the handle mechanism 100 further includes a supporting base 190 and an elastic member S, wherein the supporting base 190 has a first pivoting hole 191 and a second pivoting hole 192. With reference to FIGS. 2, 3, and 4, the second pivoting hole 192 communicates with the first pivoting hole 191, wherein an included angle Y is defined between a first axial line X1 passing the first pivoting hole 191 and a second axial line X2 passing the second pivoting hole 192. The transmission rod 130 penetrates into the first pivoting hole 191, the second pivoting hole 192 corresponds to the constraining slot 122*a* of the shafting portion 122, and the linking member 140 penetrates into the second pivoting hole 192. In this embodiment, the elastic member S is a compression spring, one end of the elastic member S contacts against the supporting base 190, and the other end of the elastic member S contacts against the linking member 140. The elastic member S is used for pushing the linking member 140 to keep the linking member 140 from protruding to the constraining slot 122*a* of the shafting portion 122.

Figure 6:
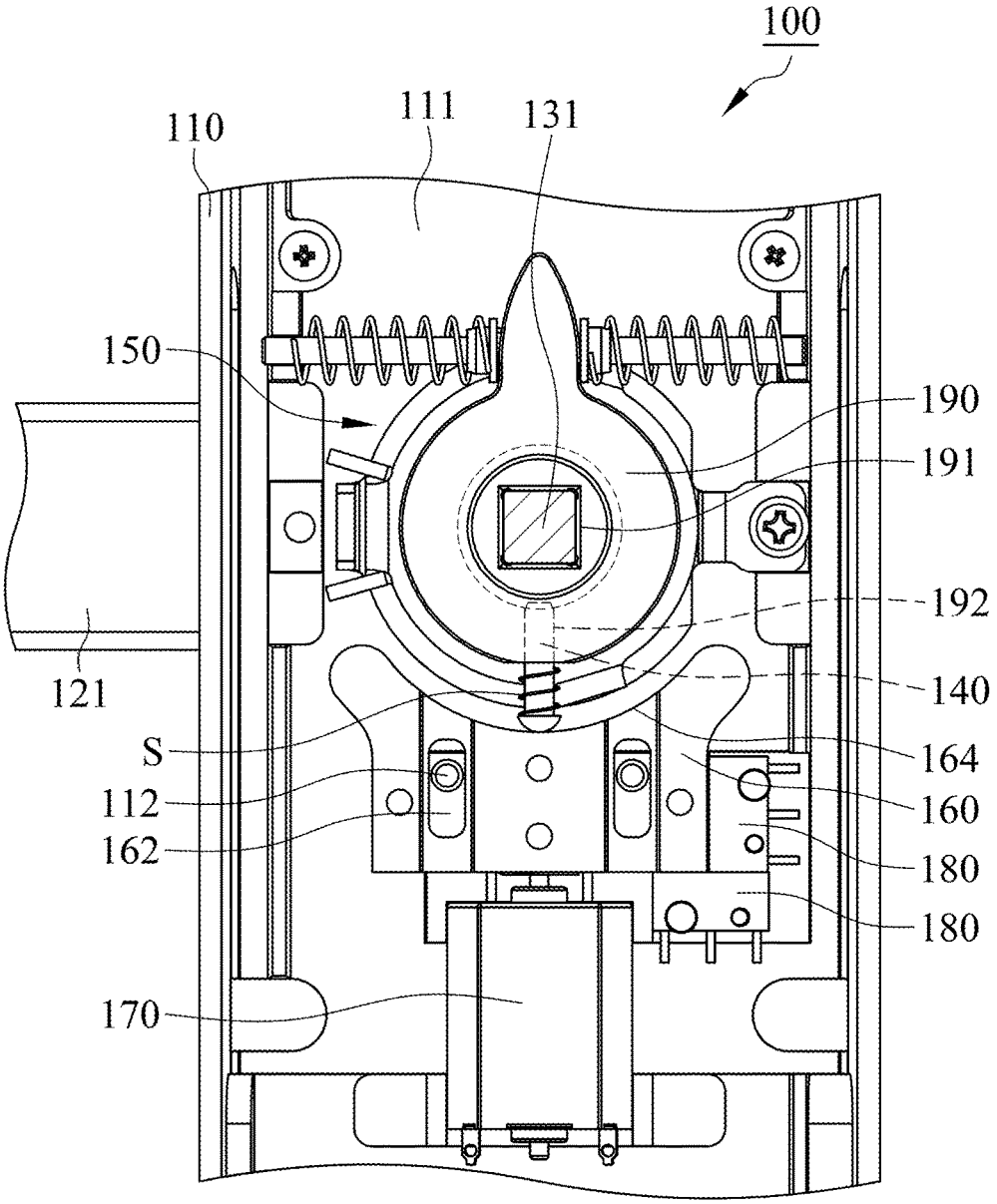
FIG. 6 is a partial enlargement view of FIG. 5.
Figure 7:
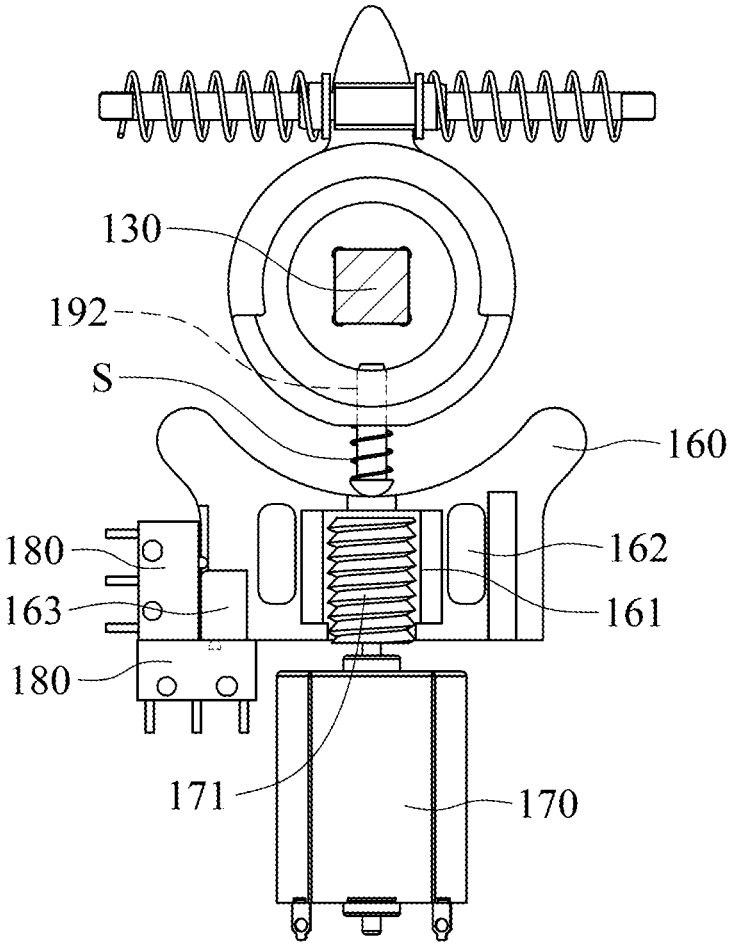
FIG. 7 is a partial front view illustrating the handle mechanism in accordance with the present invention.
Figure 8:
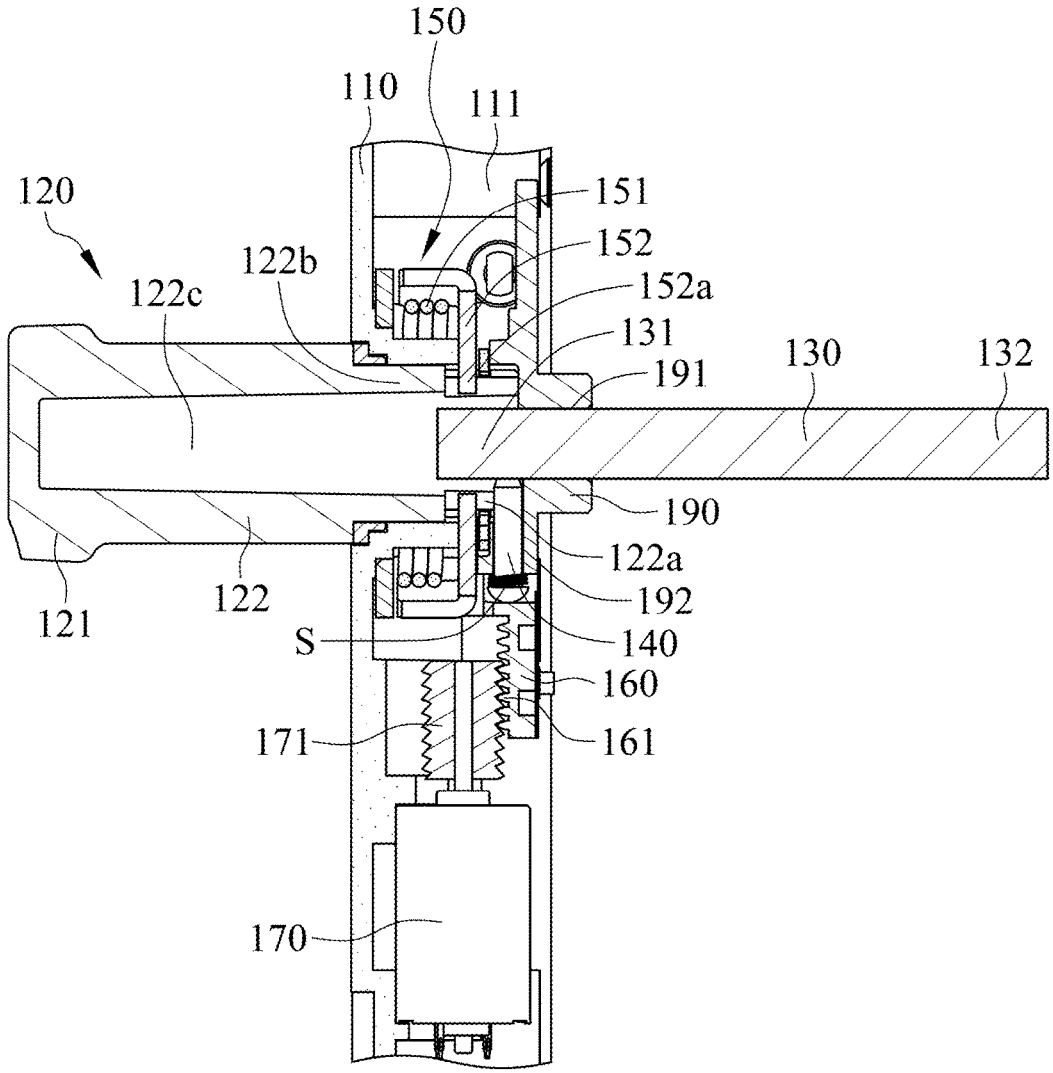
FIG. 8 is a partial sectional view illustrating the handle mechanism in operation according to the present invention.
Figure 9:
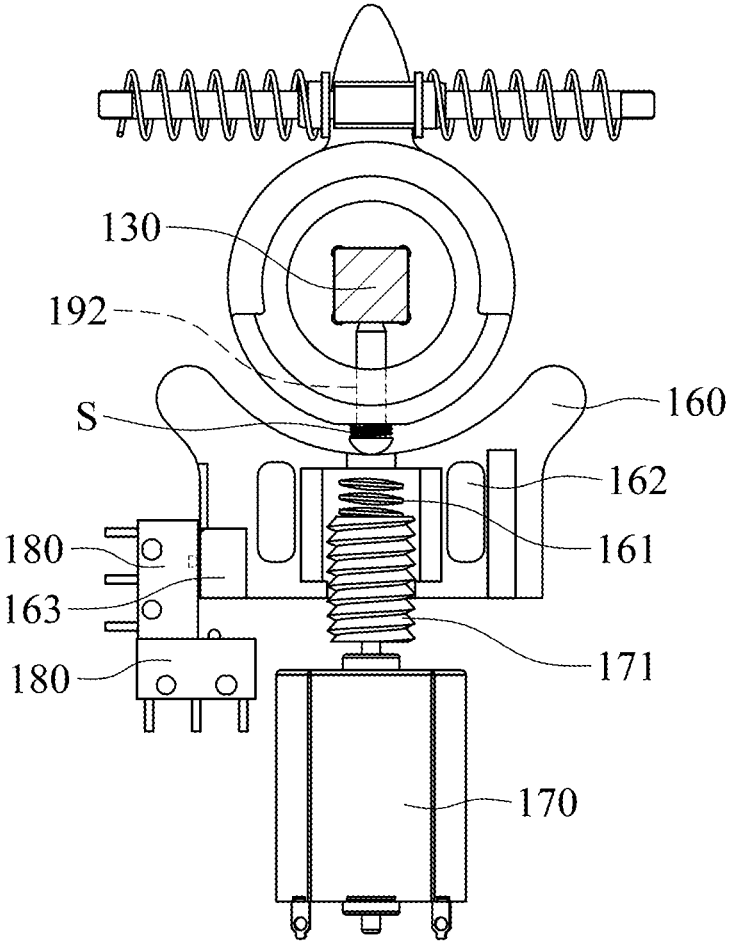
FIG. 9 is a partial front view illustrating the handle mechanism in operation according to the present invention.
Figure 10:
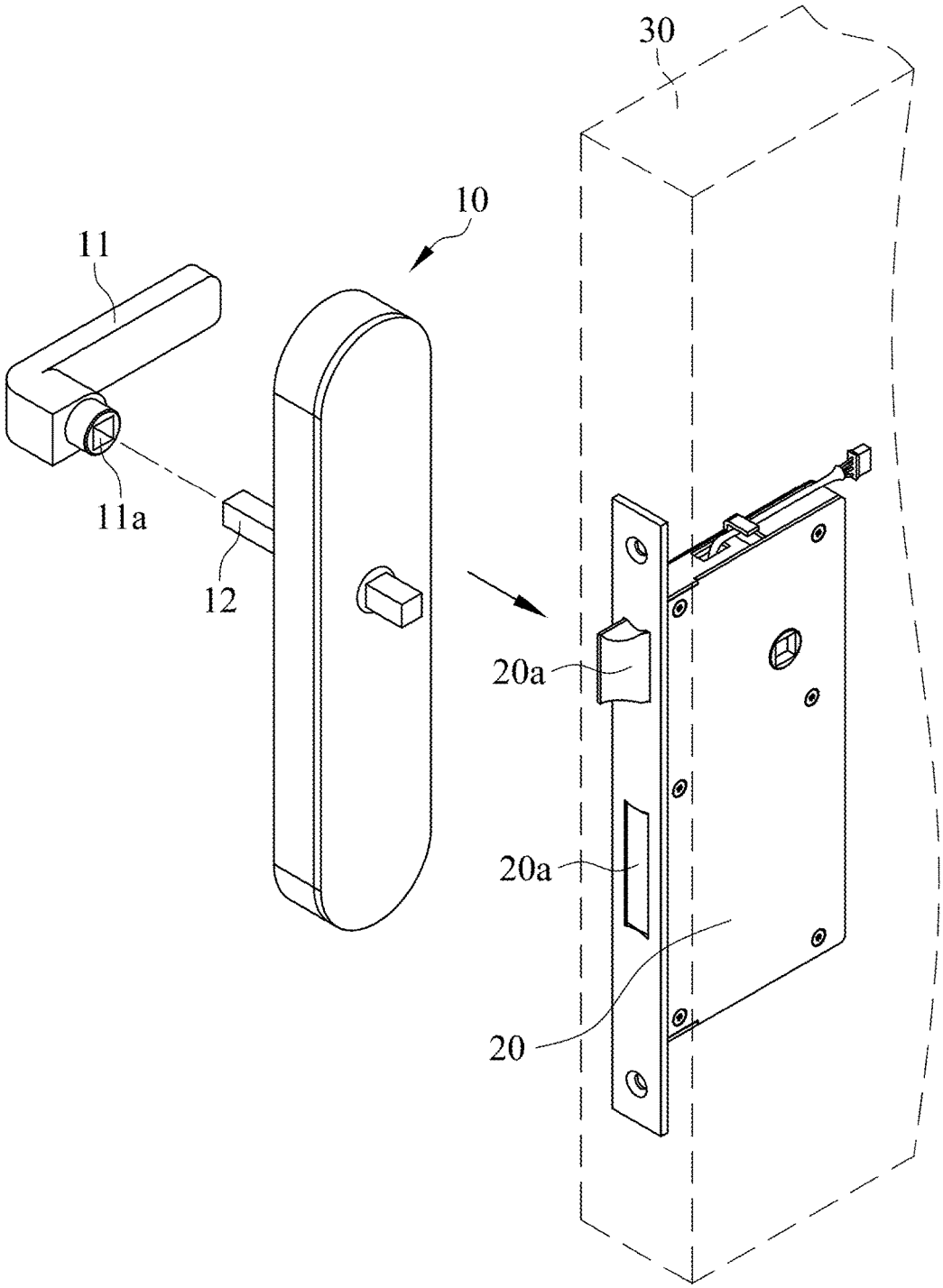
FIG. 10 PRIOR ART
FIG. 10 is a perspective diagram of a conventional handle apparatus and a conventional lock module.

With reference to FIGS. 6 and 7, the handle mechanism 100 further includes at least one switch 180 electrically connected to the motor 170. The pushing member 160 touches the switch 180 to make the motor 170 stop operating when the pushing member 160 moves upwardly or downwardly to a pre-determined position. In this embodiment, the pushing member 160 comprises a touching portion 163 used for touching the switch 180.

Illustration about the linking member 140 of the handle mechanism 100 in the present invention is selectively engaged with the shafting portion 122 of the handle 120 and the transmission rod 130 as below.

With reference to FIGS. 4, 7, 8 and 9, the motor 170 is used to drive the pushing member 160 to move when the handle 120 is made available to drive the transmission rod 130. Preferably, the pushing member 160 comprises an arc-shaped contact surface 164, and the linking member 140 contacts against the arc-shaped contact surface 164. The pushing member 160 pushes the linking member 140 which penetrates into the constraining slot 122*a* of the shafting portion 122 and the second pivoting hole 192 of the supporting base 190 to protrude to the constraining slot 122*a* of the shafting portion 122 and makes the linking member 140 contacting against the transmission rod 130. Owing to the reason that the linking member 140 is still constrained within the constraining slot 122*a* of the shafting portion 122, the axial wall 122*b* of the shafting portion 122 drives the linking member 140 to swing and the linking member 140 contacts with the arc-shaped contact surface 164 when the holding portion 121 of the handle 120 performs swinging by application of an external force. The swinging linking member 140 drives the transmission rod 130 to rotate and the lock module 200 is able to operate when the transmission rod 130 is rotating.

With reference to FIGS. 4 and 6, the motor 170 drives the pushing member 160 moving reversely, and the elastic member S pushes the linking member 140 to make the linking member 140 that penetrates into the second pivoting hole 192 of the supporting base 190 being hidden into the constraining slot 122*a* of the shafting portion 122 when the handle 120 is made unavailable to drive the transmission rod 130. Owing to the reason that the linking member 140 does not contact with the transmission rod 130, the shafting portion 122 is not able to drive the transmission rod 130 in rotation by the linking member 140 when the holding portion 121 of the handle 120 performs swinging by application of an external force. And the external force applied to the handle 120 is unable to deliver to the lock module 200, so the damage of the lock module 200 is preventable.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A handle mechanism comprising:

a case;

a handle comprising a holding portion and a shaft portion, wherein the shaft portion is pivotally connected to the case and has an accommodating hole;

a transmission rod driving a lock module in operation, wherein a horizontal axis passes through the transmission rod and the accommodating hole and wherein a first end of the transmission rod is inserted into the accommodating hole such that the first end of the transmission rod in the accommodating hole does not interfere with the shaft portion;

a linking member transversely disposed relative to the transmission rod and selectively engaging the shaft portion of the handle with the transmission rod;

a pushing member having a supporting portion provided to push the linking member toward the transmission rod; and a motor having a rotation shaft, wherein the supporting portion is engaged with the rotation shaft and the motor drives the pushing member to move the linking member, pushed by the supporting portion, to directly contact the transmission rod in the accommodating hole and wherein, when the linking member is moved to contact the transmission rod, the shaft portion of the handle is engaged with the transmission rod by the linking member and is able to rotate the transmission rod to drive the lock module in operation and wherein, when the linking member is not moved to contact the transmission rod, the shaft portion of the handle is not engaged with the transmission rod and is unable to rotate the transmission rod to drive the lock module in operation.

2. The handle mechanism in accordance with claim 1, wherein the case comprises at least one constraining member, the pushing member comprises at least one constraining rail, and the constraining member is engaged with the constraining rail such that the constraining member and the constraining rail constrain a longitudinal moving distance of the pushing member.

3. The handle mechanism in accordance with claim 1 further comprising at least one switch electrically connected to the motor, and the pushing member is used for touching the switch to make the motor stop operating.

4. The handle mechanism in accordance with claim 1, wherein the linking member movably penetrates into the accommodating hole to selectively engage with the shaft portion of the handle and the transmission rod.

5. The handle mechanism in accordance with claim 4, wherein the shaft portion of the handle comprises a constraining slot and an axial wall, the axial wall surrounds the accommodating hole, the constraining slot disposed at the axial wall penetrates through the axial wall and communicates with the accommodating hole and the constraining slot reveals the first end of the transmission rod.

6. The handle mechanism in accordance with claim 5, wherein the linking member which corresponds to the constraining slot of the shaft portion is able to penetrate through the constraining slot of the shaft portion and move toward the transmission rod to contact against the transmission rod and is able to move backward from the transmission rod to break contact with the transmission rod.

7. The handle mechanism in accordance with claim 1 further comprising a supporting base having a first pivoting hole and a second pivoting hole which communicates with the first pivoting hole, wherein an included angle is defined between a first axial line passing through the first pivoting hole and a second axial line passing through the second pivoting hole, the transmission rod penetrates into the first pivoting hole, and the linking member penetrates into the second pivoting hole.

8. The handle mechanism in accordance with claim 7 further comprising an elastic member, wherein one end of the elastic member contacts against the supporting base, and the other end of the elastic member contacts against the linking member to prevent the linking member from contacting against the transmission rod when the linking member is not pushed by the pushing member.

9. The handle mechanism in accordance with claim 1, wherein the pushing member comprises an arc-shaped contact surface, and the linking member contacts against the arc-shaped contact surface.

* * * * *